US005977876A

United States Patent [19]

Coleman

[11] Patent Number: 5,977,876

[45] Date of Patent: Nov. 2, 1999

[54] BRIEFCASE WITH REMOTELY CONTROLLED LOCKING MECHANISM

[76] Inventor: Joseph Anthony Coleman, 5008 Taylor Piedmont Rd., Spartanburg, S.C. 29303

[21] Appl. No.: 09/133,455

[22] Filed: Aug. 13, 1998

[51] Int. Cl.[6] ..... G08B 13/14

[52] U.S. Cl. ..... 340/571; 340/568; 340/539; 70/69; 70/277

[58] Field of Search ..... 340/571, 540, 340/542, 568, 539; 70/67, 69, 277

[56] References Cited

U.S. PATENT DOCUMENTS

| | | | |
|---|---|---|---|
| 4,117,468 | 9/1978 | Vasquez | 340/571 |
| 4,204,202 | 5/1980 | Pai | 340/571 |
| 4,591,835 | 5/1986 | Sharp | 340/571 |
| 4,804,943 | 2/1989 | Soleimani | 340/571 |
| 5,043,702 | 8/1991 | Kuo | 340/539 |
| 5,126,719 | 6/1992 | DeSorbo | 340/571 |
| 5,507,161 | 4/1996 | Broekaert et al. | 70/71 |

*Primary Examiner*—Daniel J. Wu
*Assistant Examiner*—Sihong Huang

[57] ABSTRACT

A security briefcase is provided including an upper half and a lower half hingably coupled. Also included is a locking mechanism for unlocking the upper half and the lower half upon the receipt of an activation signal via free space. A portable unit is provided for transmitting the activation signal via free space upon the depression of a button.

2 Claims, 2 Drawing Sheets

BRIEFCASE WITH REMOTELY CONTROLLED LOCKING MECHANISM

BACKGROUND OF THE INVENTION

1. Field of the Invention

The present invention relates to briefcase security devices and more particularly pertains to a new briefcase with remotely controlled locking mechanism for allowing a briefcase to be opened via a portable, hand-held unit and further indicating when the briefcase is being opened in an unauthorized manner.

2. Description of the Prior Art

The use of briefcase security devices is known in the prior art. More specifically, briefcase security devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art briefcase security devices include U.S. Pat. No. 4,728,937; U.S. Pat. No. 4,848,111; U.S. Pat. No. Des. 339,232; U.S. Pat. No. 5,170,907; U.S. Pat. No. 4,719,777; and U.S. Pat. No. Des. 351,591.

In these respects, the briefcase with remotely controlled locking mechanism according to the present invention substantially departs from the conventional concepts and designs of the prior art, and in so doing provides an apparatus primarily developed for the purpose of allowing a briefcase to be opened via a portable, hand-held unit and further indicating when the briefcase is being opened in an unauthorized manner.

SUMMARY OF THE INVENTION

In view of the foregoing disadvantages inherent in the known types of briefcase security devices now present in the prior art, the present invention provides a new briefcase with remotely controlled locking mechanism construction wherein the same can be utilized for allowing a briefcase to be opened via a portable, hand-held unit and further indicating when the briefcase is being opened in an unauthorized manner.

The general purpose of the present invention, which will be described subsequently in greater detail, is to provide a new briefcase with remotely controlled locking mechanism apparatus and method which has many of the advantages of the briefcase security devices mentioned heretofore and many novel features that result in a new briefcase with remotely controlled locking mechanism which is not anticipated, rendered obvious, suggested, or even implied by any of the prior art briefcase security devices, either alone or in any combination thereof.

To attain this, the present invention generally comprises an upper half and a lower half each having a rectangular face with a rectangular side wall coupled to a periphery of the rectangular face. Each side wall extends from the associated rectangular face to define a peripheral edge. As is conventional of briefcases, the upper half and the lower half are pivotally coupled at rear portions of the peripheral edges thereof. Further, a front portion of the side wall of the lower half of the briefcase has a U-shaped handle pivotally coupled thereto. As shown in FIG. 1, an interior surface of the rectangular face of the upper half has a plurality of folders mounted thereon for storage purposes. As shown in FIGS. 1 & 4, a locking assembly is provided including a pair of apertured tabs formed on a front portion of the peripheral edge of the upper half. A pair of slots are formed in a front portion of the peripheral edge of the lower half. Situated within the slots is a pair of locking devices each including a Z-shaped member. As shown in FIG. 4, such Z-shaped members are each equipped with a bottom extent having a resilient spring strip extending therefrom and coupled to a first inner wall of the associated slot. A top extent of each Z-shaped member has a trapezoidal protrusion formed thereon. By this structure, each Z-shaped member has an unbiased orientation for engaging the associated apertured tab, thereby locking the upper and lower halves of the briefcase. The locking assembly further includes a pair of electromagnets each mounted on a second inner wall of one of the compartments. The electromagnets are adapted for biasing the associated Z-shaped member out of engagement with the corresponding apertured tab upon the receipt of an unlock signal, thereby unlocking the briefcase. With reference still to FIG. 1, a pair of pneumatic cylinders are shown to each have a first end pivotally coupled to a side portion of the side wall of the lower half. A second end of each pneumatic cylinder is pivotally coupled to a side portion of the side wall of the upper half. The pneumatic cylinders each serve to automatically pivot the halves into an open orientation upon the unlocking thereof. Shown in FIG. 3 is a battery compartment formed in a central extent of the front portion of the lower half. An opening of the battery compartment is formed in the peripheral edge of the lower half. A cover is screwably coupled over the opening for the containment of batteries therein. Mounted on the central extent of the front portion of the lower half is a briefcase receiver. This briefcase receiver is connected between the batteries and the electromagnets for transmitting the unlock signal to the electromagnets only upon the receipt of an activation signal via free space. Also mounted on the briefcase is an audible alarm for generating an audible alarm upon the receipt of an alarm signal. Associated therewith is a briefcase transmitter for transmitting a remote alert signal via free space upon the receipt of the alarm signal. Connected to the audible alarm, the briefcase transmitter and the briefcase receiver is an alarm sensor including a push button momentary switch. As shown in FIGS. 1 & 3, the push button momentary switch is mounted on the peripheral edge of the lower half of the briefcase. In use, the alarm sensor has an activated mode for transmitting the alarm signal to the audible alarm and the briefcase transmitter only upon the opening of the briefcase in combination with the lack of the receipt of the activation signal. It should be noted that the alarm sensor also has a deactivated mode for precluding the transmission of the alarm signal. For reasons that will soon become apparent, the alarm sensor is adapted to toggle between the activated and deactivated modes upon the repeated receipt of a mode select signal. Finally, a portable unit is provided including a small rectangular housing with an eyelet mounted thereon for coupling a key ring thereto. As shown in FIG. 2, the housing has a portable unit receiver connected to an indicator alarm for activating the same upon the receipt of the remote alert signal via free space. A portable unit transmitter is connected to a small push button for toggling the alarm sensor between the activated and deactivated mode thereof upon the sequential depression thereof. Further, the portable unit transmitter is connected to a large push button for transmitting the activation signal via free space upon the depression thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new briefcase with remotely controlled locking mechanism apparatus and method which has many of the advantages of the briefcase security devices mentioned heretofore and many novel features that result in a new briefcase with remotely controlled locking mechanism which is not anticipated, rendered obvious, suggested, or even implied by any of the prior art briefcase security devices, either alone or in any combination thereof.

It is another object of the present invention to provide a new briefcase with remotely controlled locking mechanism which may be easily and efficiently manufactured and marketed.

It is a further object of the present invention to provide a new briefcase with remotely controlled locking mechanism which is of a durable and reliable construction.

An even further object of the present invention is to provide a new briefcase with remotely controlled locking mechanism which is susceptible of a low cost of manufacture with regard to both materials and labor, and which accordingly is then susceptible of low prices of sale to the consuming public, thereby making such briefcase with remotely controlled locking mechanism economically available to the buying public.

Still yet another object of the present invention is to provide a new briefcase with remotely controlled locking mechanism which provides in the apparatuses and methods of the prior art some of the advantages thereof, while simultaneously overcoming some of the disadvantages normally associated therewith.

Still another object of the present invention is to provide a new briefcase with remotely controlled locking mechanism for allowing a briefcase to be opened via a portable, hand-held unit and further indicating when the briefcase is being opened in an unauthorized manner.

Even still another object of the present invention is to provide a new briefcase that includes an upper half and a lower half hingably coupled. Also included is a locking mechanism for unlocking the upper half and the lower half upon the receipt of an activation signal via free space. A portable unit is provided for transmitting the activation signal via free space upon the depression of a button.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
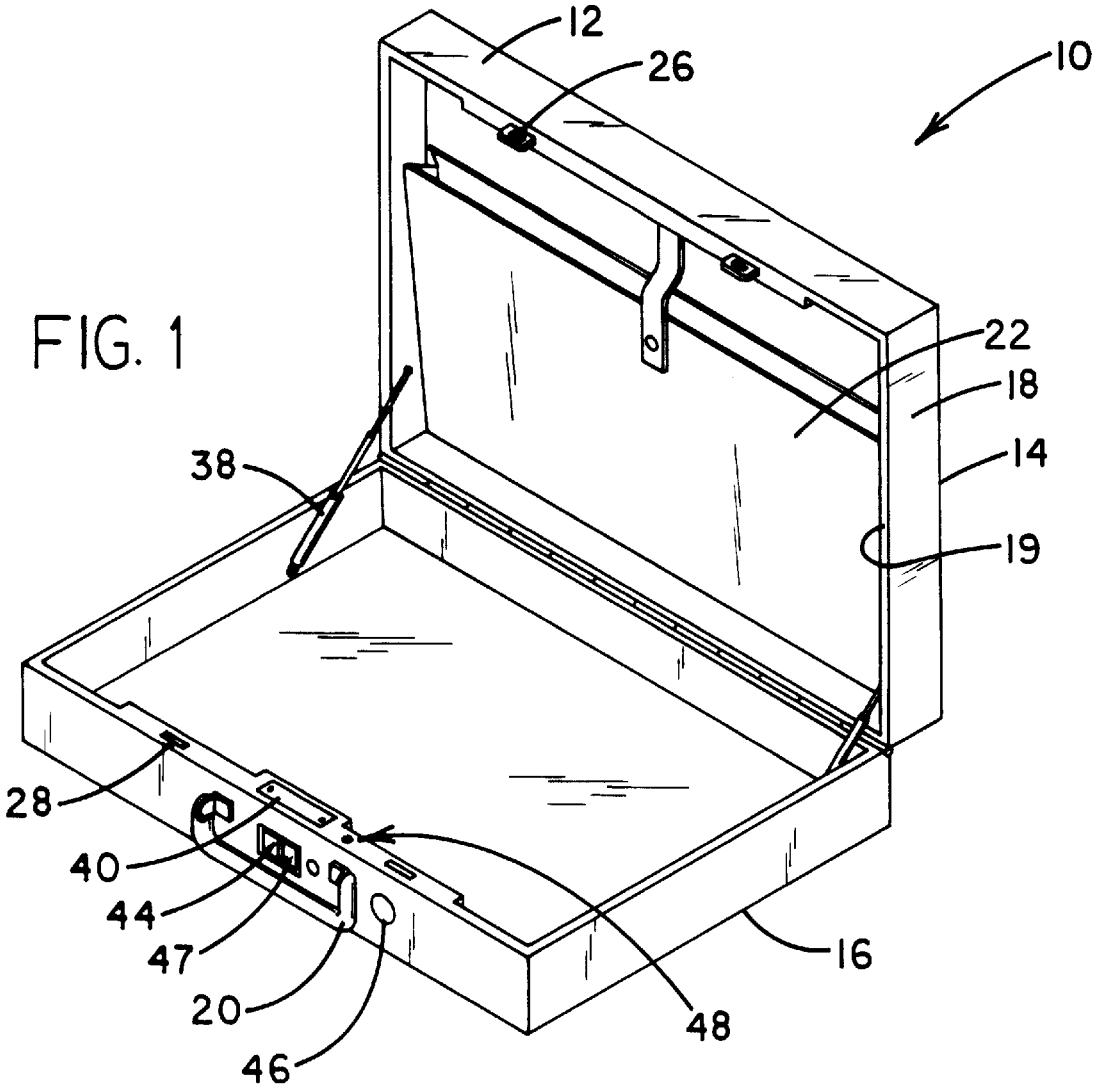
FIG. 1 is a perspective view of a new briefcase with remotely controlled locking mechanism according to the present invention.

With reference now to the drawings, and in particular to FIGS. 1 through 4 thereof, a new briefcase with remotely controlled locking mechanism embodying the principles and concepts of the present invention and generally designated by the reference numeral 10 will be described.

The present invention, designated as numeral 10, includes a briefcase 12 having an upper half 14 and a lower half 16 each having a rectangular face with a rectangular side wall 18 coupled to a periphery of the rectangular face. Each side wall extends from the associated rectangular face to define a peripheral edge 19. As is conventional of briefcases, the upper half and the lower half are pivotally coupled at rear portions of the peripheral edges thereof. Further, a front portion of the side wall of the lower half has a U-shaped handle 20 pivotally coupled thereto. As shown in FIG. 1, an interior surface of the rectangular face of the upper half has a plurality of folders 22 mounted thereon for storage purposes.

Figure 4:
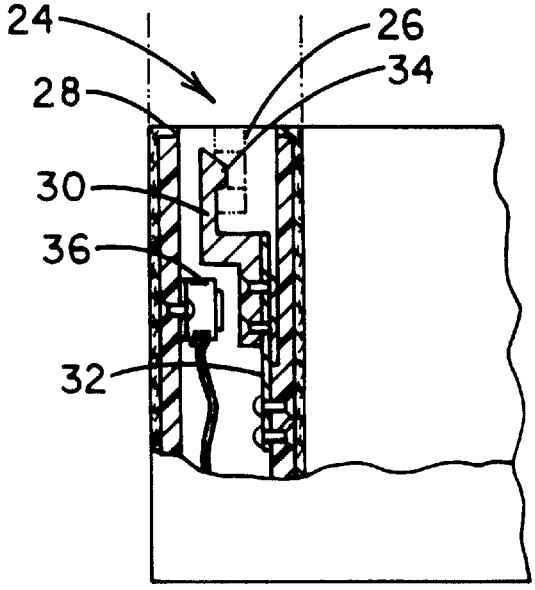
FIG. 4 is a cross-sectional view of one of the locking assemblies of the present invention taken along line 4—4 shown in FIG. 3.

As shown in FIGS. 1 & 4, a locking assembly 24 is provided including a pair of apertured tabs 26 formed on a front portion of the peripheral edge of the upper half. Further, a pair of slots 28 are formed in a front portion of the peripheral edge of the lower half. Situated within the slots is a pair of locking devices each including a Z-shaped member 30. As shown in FIG. 4, such Z-shaped members are each equipped with a bottom extent having a resilient spring strip 32 extending therefrom and coupled to a first inner wall of the associated slot. A top extent of each Z-shaped member has a trapezoidal protrusion 34 formed thereon. By this structure, each Z-shaped member has an unbiased orientation for engaging the associated apertured tab, thereby locking the upper and lower halves of the briefcase.

The locking assembly further includes a pair of electromagnets 36 each mounted on a second inner wall of one of the compartments. The electromagnets are adapted for biasing the associated Z-shaped member out of engagement with the corresponding apertured tab upon the receipt of an unlock signal, thereby unlocking the briefcase.

With reference still to FIG. 1, a pair of pneumatic cylinders 38 are shown to each have a first end pivotally coupled to a side portion of the side wall of the lower half. A second end of each pneumatic cylinder is pivotally coupled to a side portion of the side wall of the upper half. The pneumatic cylinders each serve to automatically pivot the halves into an open orientation upon the unlocking of the locking assembly. As an option, the pneumatic cylinders may be spring loaded.

Figure 3:
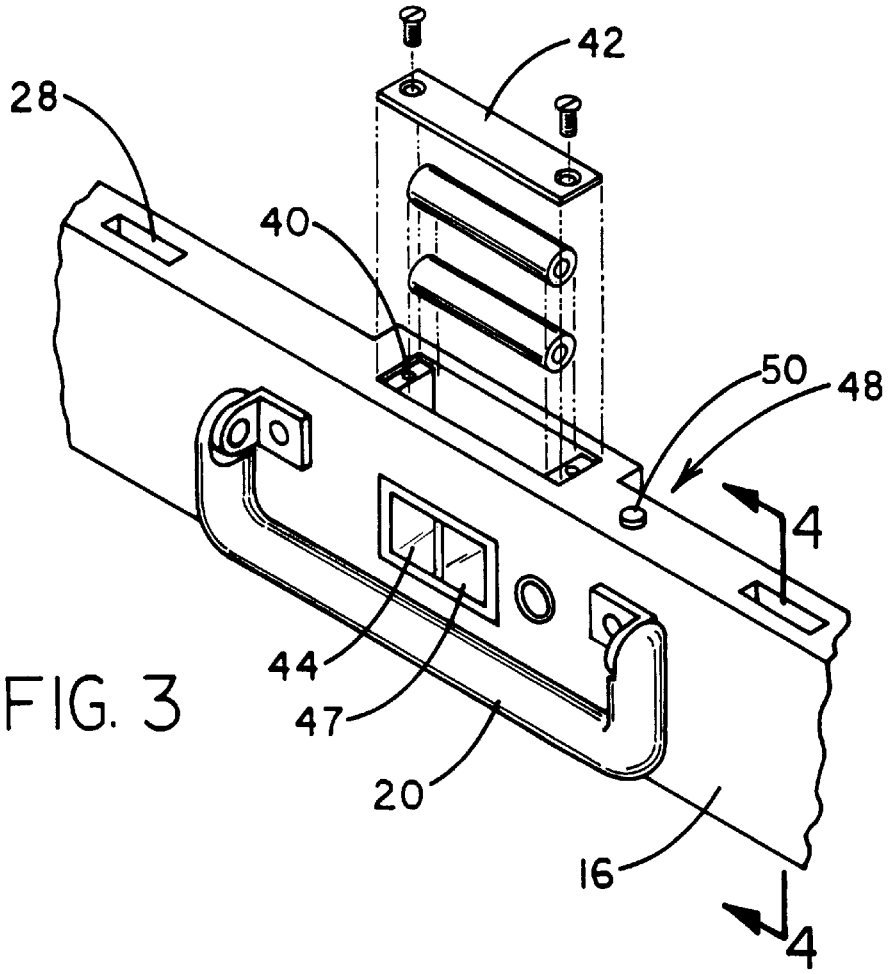
FIG. 3 is a detailed perspective view of the present invention.

Shown in FIG. 3 is a battery compartment 40 formed in a central extent of the front portion of the lower half. An opening of the battery compartment is formed in the peripheral edge of the lower half. A cover 42 is screwably coupled over the opening for the containment of batteries therein.

Mounted on the central extent of the front portion of the lower half is a briefcase receiver 44. This briefcase receiver is connected between the batteries and the electromagnets for transmitting the unlock signal to the electromagnets only upon the receipt of an activation signal via free space.

Also mounted on the briefcase is an audible alarm 46 for generating an audible alarm upon the receipt of an alarm signal. Associated therewith is a briefcase transmitter 47 for transmitting a remote alert signal via free space upon the receipt of the alarm signal.

Connected to the audible alarm, briefcase transmitter and briefcase receiver is an alarm sensor 48 including a push button momentary switch 50. As shown in FIGS. 1 & 3, the push button momentary switch is mounted on the peripheral edge of the lower half of the briefcase. In use, the alarm sensor has an activated mode for transmitting the alarm signal to the audible alarm and the briefcase transmitter only upon the opening of the briefcase in combination with the lack of the receipt of the activation signal. It should be noted that the alarm sensor also has a deactivated mode for precluding the transmission of the alarm signal. For reasons that will soon become apparent, the alarm sensor is adapted to toggle between the activated and deactivated modes upon the repeated receipt of a mode select signal. In view of the straight forward nature of the function of the alarm sensor, it should be understood that the same may be accomplished by way of simple logic circuitry with a state table or the like. In the alternative, a processor and associated memory may be employed with a controller program.

Figure 2:
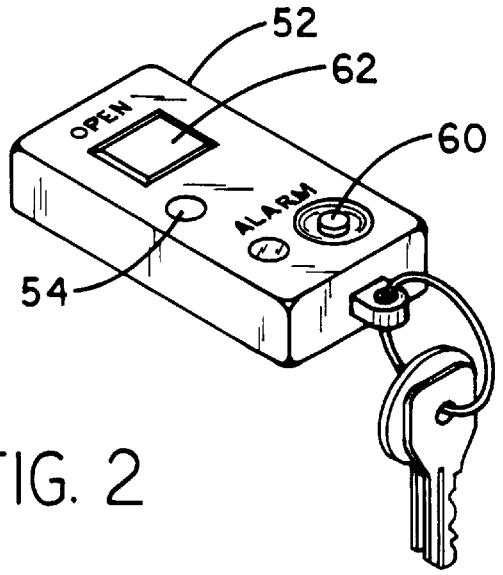
FIG. 2 is a perspective view of the portable unit of the present invention.

Finally, a portable unit 52 is provided including a small rectangular housing with an eyelet mounted thereon for coupling a key ring thereto. As shown in FIG. 2, the housing has a portable unit receiver connected to a visual and/or audio indicator alarm 56 for activating the same upon the receipt of the remote alert signal via free space. A portable unit transmitter is connected to a small push button 60 for toggling the alarm sensor between the activated and deactivated modes upon the sequential depression thereof. Further, the portable unit transmitter is connected to a large push button 62 for transmitting the activation signal via free space upon the depression thereof.

In the preferred embodiment, the alarm sensor has connected thereto an indicator light which illuminates whenever the alarm sensor is in the activated mode. Further, the alarm sensor transmits by way of the briefcase transmitter a signal which effects the illumination of an indicator light mounted on the portable housing to indicate that the alarm sensor is in the activated mode.

In use, a user of the present invention may selectively unlock the briefcase upon the depression of the large push button of the portable unit. When unlocked, the briefcase automatically opens by means of the pneumatic cylinders. If the alarm sensor has been put in the activated mode with the portable unit, lights on both the briefcase and portable unit indicate the same. If an unauthorized person opens the briefcase without the use of the portable unit, the alarm sensor transmits alarms from both the briefcase and the portable unit.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A security briefcase comprising, in combination:

an upper half and a lower half each having a rectangular face with a rectangular side wall coupled to a periphery of the rectangular face and extended therefrom to define a peripheral edge, wherein the upper half and the lower half are pivotally coupled at rear portions of the peripheral edges thereof, a front portion of the side wall of the lower half of the briefcase having a U-shaped handle pivotally coupled thereto, an interior surface of the rectangular face of the upper half having a plurality of folders mounted thereon for storage purposes;

a locking assembly including a pair of apertured tabs formed on a front portion of the peripheral edge of the upper half, a pair of slots formed in a front portion of the peripheral edge of the lower half, and a pair of locking devices each including a Z-shaped member with a bottom extent having a resilient spring strip extending therefrom and coupled to a first inner wall of the associated slot and a top extent with a trapezoidal protrusion formed thereon, wherein each Z-shaped member has an unbiased orientation for engaging the associated apertured tab, thereby locking the upper and lower halves of the briefcase, the locking assembly further including a pair of electromagnets each mounted on a second inner wall of one of the compartments for biasing the associated Z-shaped member out of engagement with the corresponding apertured tab upon the receipt of an unlock signal, thereby unlocking the briefcase;

a pair of pneumatic cylinders each having a first end pivotally coupled to a side portion of the side wall of the lower half and a second end pivotally coupled to a side portion of the side wall of the upper half, the pneumatic cylinders each adapted to automatically pivot the halves into an open orientation upon the unlocking thereof;

a battery compartment formed in a central extent of the front portion of the lower half with an opening formed in the peripheral edge thereof and a cover screwably coupled over the opening for the containment of batteries therein;

a briefcase receiver mounted on the central extent of the front portion of the lower half and connected between the batteries and the electromagnets for transmitting the unlock signal to the electromagnets only upon the receipt of an activation signal via free space;

an audible alarm mounted on the briefcase for generating an audible alarm upon the receipt of an alarm signal;

a briefcase transmitter mounted on the briefcase for transmitting a remote alert signal via free space upon the receipt of the alarm signal;

an alarm sensor including a push button momentary switch mounted on the peripheral edge of the lower half and connected to the audible alarm, the briefcase transmitter and the briefcase receiver, the alarm sensor having an activated mode for transmitting the alarm signal to the audible alarm and the briefcase transmitter only upon the opening of the briefcase in combination with the lack of the receipt of the activation signal, the alarm sensor having a deactivated mode for precluding the transmission of the alarm signal; and a portable unit including a small rectangular housing with an eyelet mounted thereon for coupling a key ring thereto, the housing having a portable unit receiver connected to an indicator alarm for activating the same upon the receipt of the remote alert signal via free space, a portable unit transmitter connected to a small push button for toggling the alarm sensor between the activated and deactivated mode thereof upon the sequential depression thereof, wherein the portable unit transmitter is further connected to a large push button for transmitting the activation signal via free space upon the depression thereof.

2. A security briefcase comprising:

an upper and a lower half each having a face with a side wall coupled to a periphery of the face and extended therefrom to define a peripheral edge, wherein the upper half and the lower half are pivotally coupled at rear portions of the peripheral edges thereof, a front portion of the side wall of the lower half of the briefcase having a handle pivotally coupled to the said wall, an interior surface of the face of the upper half having a plurality of folders mounted thereon for storage purposes;

a locking assembly including a pair of tabs formed on a front portion of the peripheral edge of the upper half, each of the tabs having an aperture therein, a pair of slots formed in a front portion of the peripheral edge of the lower half, and a pair of locking devices each including a Z-shaped member with a top extent and a bottom extent, the bottom extent having a resilient spring strip extending therefrom and coupled to a first inner wall of the associated slot, the top extent having a trapezoidal protrusion formed thereon, wherein each Z-shaped member has an unbiased orientation for engaging the associated tab for locking the upper and lower halves of the briefcase, the locking assembly further including a pair of electromagnets each mounted on a second inner wall of one of the compartments for biasing the associated Z-shaped member out of engagement with the corresponding tab upon the receipt of an unlock signal for unlocking the briefcase;

a pair of pneumatic cylinders each having a first end pivotally coupled to a side portion of the side wall of the lower half and a second end pivotally coupled to a side portion of the side wall of the upper half, the pneumatic cylinders each adapted to pivot the halves into an open orientation upon the unlocking thereof;

a battery compartment formed in the front portion of the lower half with an opening formed in the peripheral edge thereof and a cover coupled over the opening for the containment of batteries therein;

a briefcase receiver mounted on the front portion of the lower half and electrically connected to the electromagnets for transmitting the unlock signal to the electromagnets only upon the receipt of an activation signal via free space;

an audible alarm mounted on the briefcase for generating an audible alarm upon the receipt of an alarm signal;

a briefcase transmitter mounted on the briefcase for transmitting a remote alert signal via free space upon the receipt of the alarm signal;

an alarm sensor including a switching mounted on the peripheral edge of the lower half of the briefcase and connected to the audible alarm, the briefcase transmitter and the briefcase receiver, the alarm sensor having and activated mode for transmitting the alarm signal to the audible alarm and the briefcase transmitter only upon the opening of the briefcase in combination with the lack of the receipt of the activation signal, the alarm sensor having a deactivated mode for precluding the transmission of the alarm signal; and a portable unit including a housing having a portable unit receiver connected to an indicator alarm for activating the same upon the receipt of the remote alert signal via free space, a portable unit transmitter connected to a first push button for toggling the alarm sensor between the activated and deactivated mode thereof upon the depression of the first push button, wherein the portable unit transmitter is further connected to a second push button for transmitting the activation signal via free space upon the depression thereof.

* * * * *